US006056631A

United States Patent [19]

Brown et al.

[11] Patent Number: 6,056,631

[45] Date of Patent: May 2, 2000

[54] CHEMICAL MECHANICAL POLISH PLATEN AND METHOD OF USE

[75] Inventors: Thomas M. Brown; Peter Austin Burke, both of Austin, Tex.

[73] Assignee: Advanced Micro Devices, Inc., Austin, Tex.

[21] Appl. No.: 08/947,600

[22] Filed: Oct. 9, 1997

[51] Int. Cl.[7] ..... B24B 7/22

[52] U.S. Cl. ..... 451/288; 451/57

[58] Field of Search ..... 451/41, 288, 287, 451/537, 530, 461, 57, 60, 446, 290, 289

[56] References Cited

U.S. PATENT DOCUMENTS

| | | | |
|---|---|---|---|
| 3,841,031 | 10/1974 | Walsh | 451/41 |
| 3,857,123 | 12/1974 | Walsh | 451/41 |
| 4,481,741 | 11/1984 | Bouladon et al. | 451/287 |
| 5,435,772 | 7/1995 | Yu | 451/41 |
| 5,503,590 | 4/1996 | Saitah et al. | 451/398 |
| 5,503,592 | 4/1996 | Neumann | 451/461 |
| 5,554,064 | 9/1996 | Breivogel et al. | 451/41 |
| 5,679,063 | 10/1997 | Kimura et al. | 451/287 |

FOREIGN PATENT DOCUMENTS

| | | | |
|---|---|---|---|
| 9192453 | 10/1984 | Japan | 451/288 |

OTHER PUBLICATIONS

Ali et al., "Chemical–mechanical polishing of interlayer dielectric: A review," *Solid State Technology*, 5 pgs. (Oct. 1994).

Cook et al., "Theoretical and Practical Aspects of Dielectric and Metal CMP," *Semiconductor International*, 3 pgs. (Nov. 1995).

DeJule, "Advances in CMP," *Semiconductor International*, pp. 88–96 (Nov. 1996).

Kim et al., "Optimized Process Developed For Tungsten CMP," *Semiconductor International*, 4 pgs. (Nov. 1996).

IBM Technical Disclosure Bulletin, Hause, et al, "Wafer Polishing Process", vol. 20, No. 9, Feb. 1978.

*Primary Examiner*—Robert A. Rose
*Attorney, Agent, or Firm*—Williams, Morgan & Amerson, P.C.

[57] ABSTRACT

The present disclosure relates to a chemical mechanical polishing apparatus used for polishing wafers. The apparatus includes a polish platen and structure for separating the platen into at least first and second zones such that polishing fluid used in the first zone is prevented from entering the second zone.

25 Claims, 7 Drawing Sheets

CHEMICAL MECHANICAL POLISH PLATEN AND METHOD OF USE

FIELD OF THE INVENTION

The present invention relates generally to apparatuses and methods for fabricating integrated circuits. More specifically, the present invention relates to apparatuses and methods for chemical mechanical polishing integrated circuit wafers.

BACKGROUND OF THE INVENTION

Chemical mechanical polishing is used in the semiconductor industry to fabricate integrated circuit wafers having a high degree of planarity and uniformity. Chemical mechanical polishing typically involves the removal of an oxide or tungsten layer from the surface of a wafer such that peaks and valleys are removed from the wafer surface. The removal process utilizes an abrasive slurry disbursed in an alkaline or acidic solution to planarize the surface of the wafer through a combination of mechanical and chemical action.

One type of chemical mechanical polishing system has a rotatable circular platen or table on which a polishing pad is mounted. A multi-head polishing device is positioned above the table. The polishing device has multiple rotating carrier heads to which wafers can be secured typically through the use of vacuum pressure. In use, the platen is rotated and an abrasive slurry is disbursed onto the polishing pad of the platen. Once the slurry has been applied to the polishing pad, the rotating carrier heads move downward to press their corresponding wafers against the polishing pad. As the wafer is pressed against the polishing pad, the surface of the wafer is mechanically and chemically polished.

To achieve a desired level of planarity and uniformity on a given wafer, it is common to use a sequence of different polishing steps. Each different polishing step in the sequence may use a different slurry or different polishing pad. Current polishing art teaches using separate polishing platen for each step in a sequence of polishing steps. This is especially true because incompatible slurries and polishing pad systems are often needed in a particular sequence of polishing steps. The motivation for utilizing separate polishing platens is primarily to prevent undesired chemical reactions or polishing defects. Separate platens also allow entirely different polishing pad types to be used throughout a sequence of polishing steps.

SUMMARY OF THE INVENTION

One aspect of the present invention relates to a chemical mechanical polishing apparatus adapted for polishing wafers. The apparatus includes a polishing platen and means for separating the platen into at least first and second zones such that polishing fluids such as rinses or slurries used in the first zone are prevented from entering the second zone. The means for separating the platen can, for example, include a variety of structures such as baffles, channels, drains, and height differences. The polishing apparatus can, for example, also include a carrier having a rotatable head for mounting an integrated circuit wafer, and means for selectively providing polishing fluid to the first and second zones of the platen.

Another aspect of the present invention relates to a chemical mechanical polish method for polishing a wafer. The method includes the step of providing a polish platen including first and second zones, the first zone having a first polish pad and the second zone having a second polish pad. The method may also include the step of applying a first polishing fluid to the first pad and polishing the wafer at the first pad. The method may further include the step of applying a second polishing fluid to the second pad and polishing the wafer at the second pad. The method can, for example, utilize first and second pads, and first and second polishing fluids, that have different polish characteristics. Furthermore, the method may, for example, utilize first and second polishing fluids that are incompatible with one another.

In accordance with other aspects of the invention, methods and apparatuses for performing more than one independent polish process on a single platen are provided. The present invention may also provide methods and apparatuses suitable for allowing at least two separate and potentially incompatible chemical mechanical polishing processes to be performed on a single platen. The various aspects of the present invention can, for example, provide a chemical mechanical polishing process which can be less expensive than existing processes. Additionally, various aspects of the present invention can, for example, provide a chemical mechanical polishing process having smaller floor space requirements than known processes. Furthermore, the present invention may, for example, enable superior implementation of new technology and multi-step polishing processes such as copper-damascene chemical mechanical polishing.

A variety of additional advantages of the invention will be set forth in part in the description which follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

Figure 1:
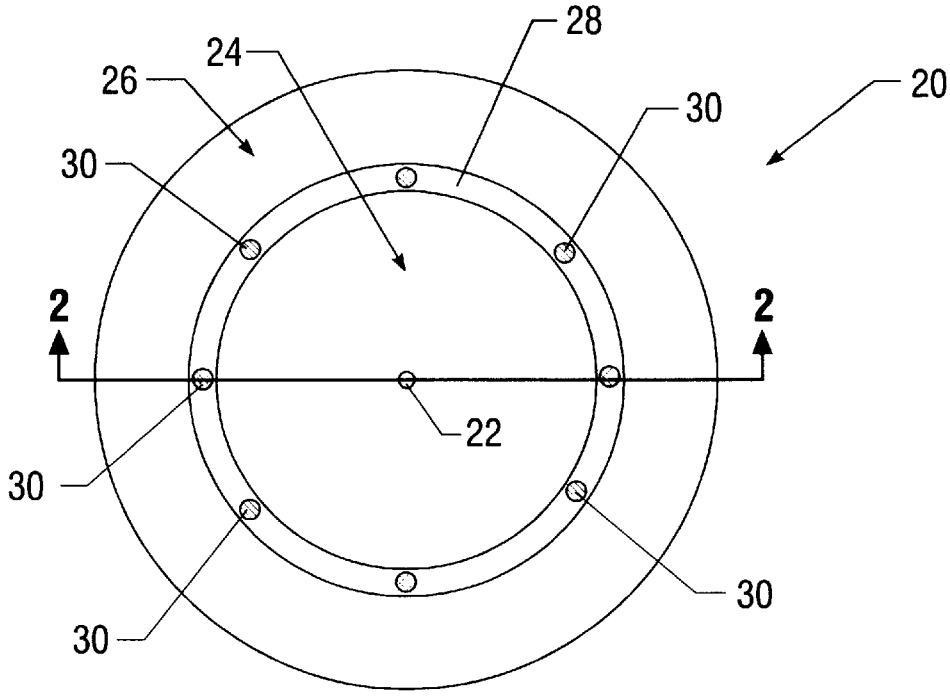
FIG. 1 is a plan view of a polish platen constructed in accordance with the principles of the present invention.
Figure 2:
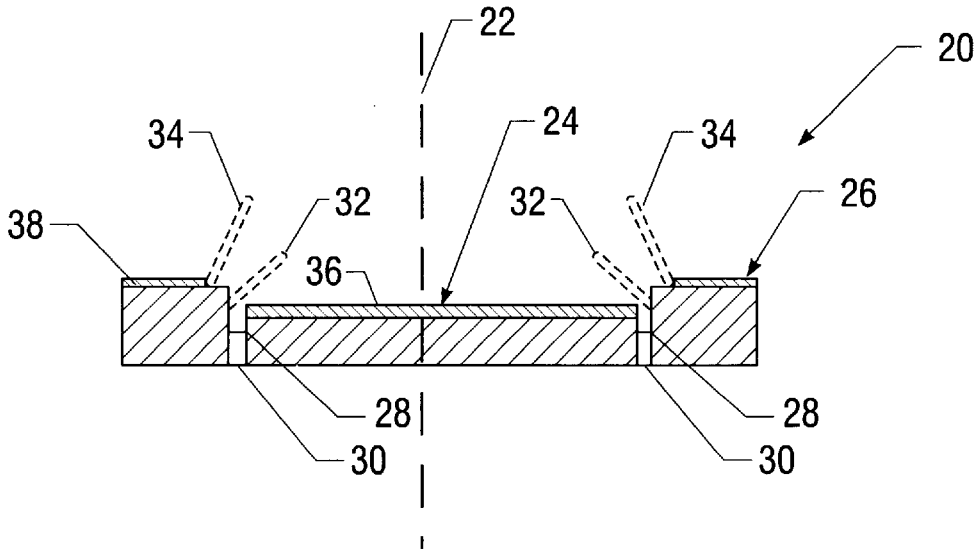
FIG. 2 is a cross-sectional view taken along section line 2—2 of FIG. 1.

FIGS. 1 and 2 illustrate an exemplary chemical mechanical polish platen or table 20 constructed in accordance with the principles of the present invention. The platen 20 is rotatable about a central axis 22 and is divided into two separate polishing zones. The polishing zones of the platen 20 include an inner radial zone 24 that is substantially circular, and an outer radial zone 26 that is substantially annular in shape. Both the inner and outer zones 24, 26 are generally centered about the rotation axis 22 of the platen 20.

A variety of techniques can be used to separate the platen 20 into separate first and second zones. As shown in FIGS. 1 and 2, the inner and outer zones 24, 26 are separated by an annular channel 28 defined between the zones. The platen 20 also defines a plurality of drainage passageways 30 in fluid communication with the channel 28 for draining polish fluids such as slurries or rinses that may flow into the channel 28. The polish platen 20 also utilizes a height difference to maintain separation between the inner and outer zones 24, 26. Specifically, the inner zone 24 is recessed with respect to the outer zone 26.

Another technique for separating multiple zones of a polish platen involves the use of baffles positioned between the zones. For example, two types of optional baffles are illustrated in phantom line in FIG. 2. A first baffle 32 projects radially inward from an outer wall of the annular channel 28. The first baffle 32 forms an oblique angle with respect to the outer wall of the channel 28 and is configured such that a portion of the baffle projects over the inner zone 24 of the platen 20. It will be appreciated that the first baffle 32 is recessed with respect to the polishing surface of the outer radial zone 26. Such a configuration is advantageous because it allows wafers to overhang the inner edge of the outer radial zone 26 during polishing and also helps maximize the polishing surface area of the platen 20. The first baffle 32 would most likely also define drainage openings located adjacent to the location in which the first baffle 32 is connected to the outer wall of the annular channel 28. Such drainage openings prevent fluid from accumulating on the baffle 32 in a region between the baffle 32 and the outer wall of the annular channel 28.

FIG. 2 also illustrates in phantom line a second optional baffle 34 for separating the platen 20 into separate regions. The second baffle 34 projects upward from the polishing surface of the outer radial zone 26. The baffle 34 can be perpendicular with respect to the surface of the outer radial zone 26, or may form an oblique angle with respect to the polishing surface of the outer radial zone 26. Each of the baffles 32, 34 are annular and project upward from the polish platen 20 a sufficient distance to prevent fluids used in chemical mechanical polishing processes, such as slurries or rinses, from splattering or otherwise moving between the inner and outer zones 24, 26. In this manner, the baffles 32, 34 help to maintain fluid separation between the zones 24, 26 such that completely separate polish steps can be performed at each zone.

Referring back to FIG. 2, inner and outer polish pads 36, 38 are shown respectively mounted on the polish surfaces of the inner and outer zones 24, 26. Those skilled in the art will appreciate that the polish pads 36, 38 can have any number of known configurations. For example, the pads 36, 38 can be manufactured from materials such as polyurethane, polyurethane-impregnated polyester felts, or any other type of material conventionally used in the polishing art. The inner and outer pads 36, 38 can each be made of the same material and can have the same polishing characteristics. Alternatively, the inner and outer pads 36, 38 can be made of different materials and have different polishing characteristics. For example, the outer pad 38 can be harder than the inner pad 36. In such a configuration, it may be desirable to perform primary polishing steps at the outer radial zone 26 and perform secondary polishing or buffing steps at the inner zone 24 of the platen 20. Of course, the present invention is not limited to configurations in which an outer pad is harder than an inner pad. For example, in certain embodiments, both pads may have identical configurations or an inner pad may be harder than an outer pad. Other differences in polishing properties that may exist between the inner and outer pads 36, 38 include, among other things, absorbency, roughness, texture and compressibility.

The configuration of FIGS. 1 and 2 aids in the segregation of polishing fluids between the inner and outer zones 24, 26. Specifically, during polishing operations, polishing fluid applied to the inner zone 24 will flow outward by centrifugal force to the annular channel 28. The elevation difference between the inner and outer zones 24, 26 prevents polishing fluid from the inner zone 24 from contaminating the outer zone 26. The optional baffles also help to prevent polishing fluid from flowing or otherwise moving between zones.

During polishing operations, polishing fluid that is applied to the outer zone 26 flows outward via centrifugal force. Consequently, such polishing fluid flows away from the inner radial zone 24 and off the outer edge of the polish platen 20 during chemical mechanical polishing processes.

Those skilled in the art will appreciate that the configuration of FIGS. 1 and 2 allows an inner diameter/outer diameter process to be run on the outer radial zone 26. Furthermore, the optional baffles 32, 34 can be detachably connected to the polish platen 20 to enable such baffles to be easily connected or disconnected from the platen 20. This invention also teaches that by segmenting the polishing process and platen simultaneously, recirculation and reclaiming of polishing fluid is facilitated. For example, polishing fluid applied to the inner zone 24 can be collected from the drains 30 and recycled or reused.

The polishing platen 20 can also be configured so that the inner and outer zones 24, 26 can be vertically moved relative to one another to control or adjust the height difference that exists between the zones 24, 26. Similarly, the baffles 32, 34 can be configured to raise and lower relative to the platen 20. The raising and lowering of the baffles 32, 34 or the relative vertical movement between the inner and outer zones 24, 26, can be controlled by means such as a computer and coordinated with the opening and closing of recirculation or collection drains that are selectively in fluid communication with the drain 30. When pure slurry is flowed on the platen 20, the baffles 32, 34 or the outer zone 26 can be raised and the collection drains can be opened such that the slurry dispensed from the platen flows from the drains 30 through the open collection drains to a collection re-circulation chamber. By contrast, when rinses or other chemistries that may dilute or change the slurry are present, the collection drains can be closed by an automatic solenoid valve or similar structure for controlling fluid flow through the drains.

Figure 3:
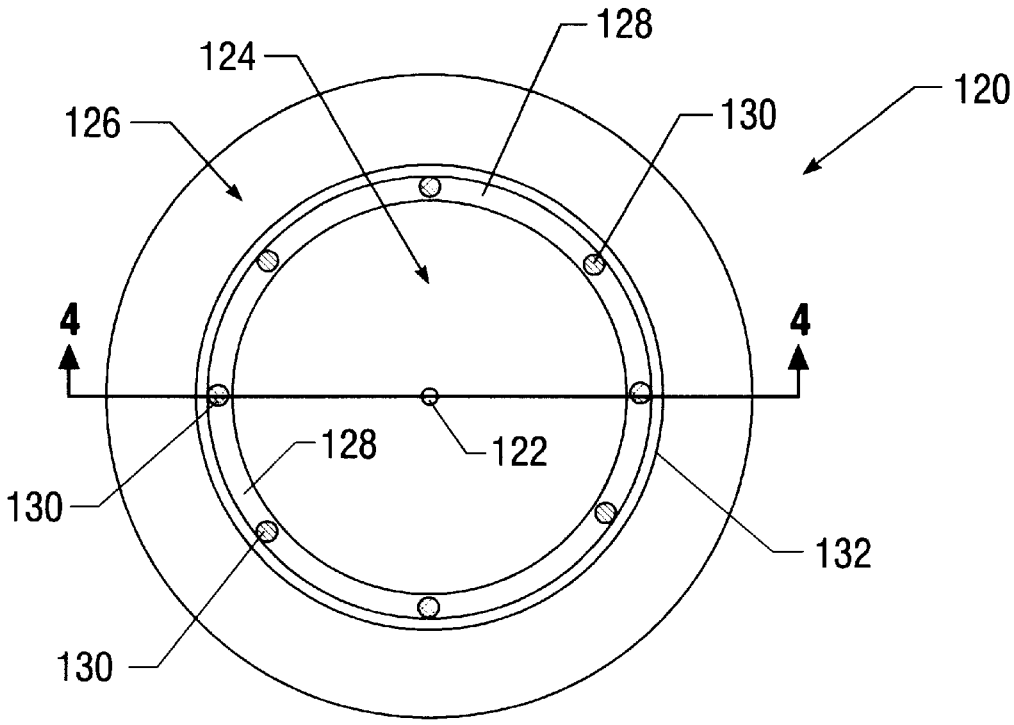
FIG. 3 is a plan view of another polish platen constructed in accordance with the principles of the present invention.
Figure 4:
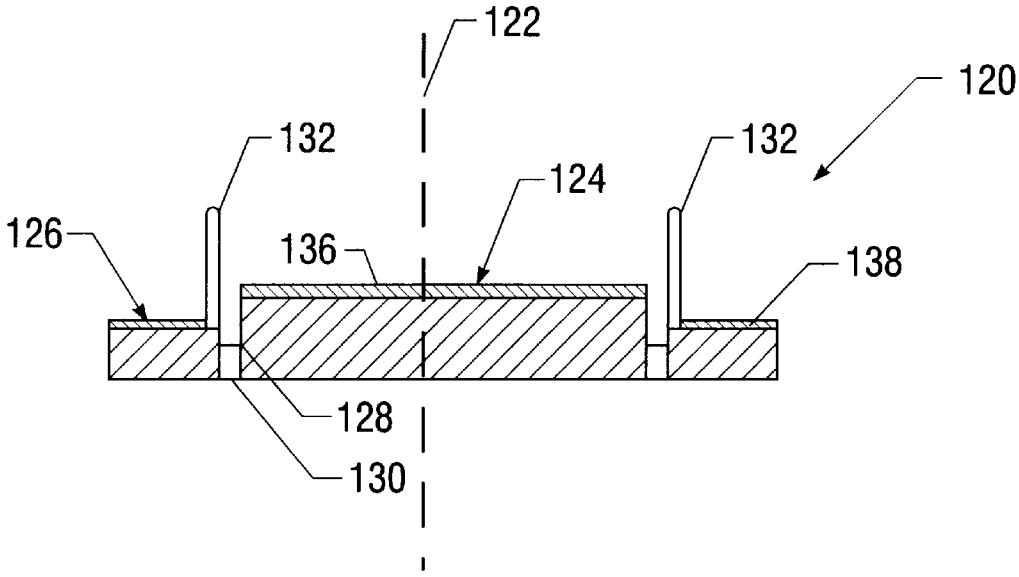
FIG. 4 is a cross-sectional view taken along section line 4—4 of FIG. 3.

FIGS. 3 and 4 illustrate an alternative polish platen 120 constructed in accordance with the principles of the present invention. The platen 120 is rotatable about a central axis 122 and includes an inner zone 124 and an outer zone 126. The inner and outer zones 124, 126 are separated by an annular channel 128 which is drained by a plurality of drainage passageways 130 extending through the polish platen 120. The inner zone 124 and outer zone 126 are also separated by a fluid divider such as an annular baffle 132 positioned between the zones.

Referring to FIG. 4, the inner zone 124 is elevated with respect to the outer zone 126. Additionally, a circular inner polish pad 136 is mounted on the inner zone 124, while an annular outer polish pad 138 is mounted on the outer zone 126. As previously described, the polish pads 136, 138 can have the same or different polishing characteristics.

Of course, the platen 120 need not include the baffle 132 or the channel 128. The platen 120, absent the baffle and channel 128, can be used to perform a variety of polish functions. For example, a primary polish step using a primary polish slurry can be conducted at the outer zone 126. During the primary polish step, the elevation difference between the inner and outer zones 124, 126 prevents slurry from entering the inner zone 124. After the primary polish step has been completed, a cleansing or buffing step can be conducted at the inner zone 124. During the cleansing step, a water based cleansing polish, which is compatible with the primary slurry used at the outer zone 126, can be used. Because the cleansing polish and the primary polish slurry are compatible, the cleansing polish can be allowed to move from the inner zone 124 to the outer zone 126 without adverse results.

Figure 5:
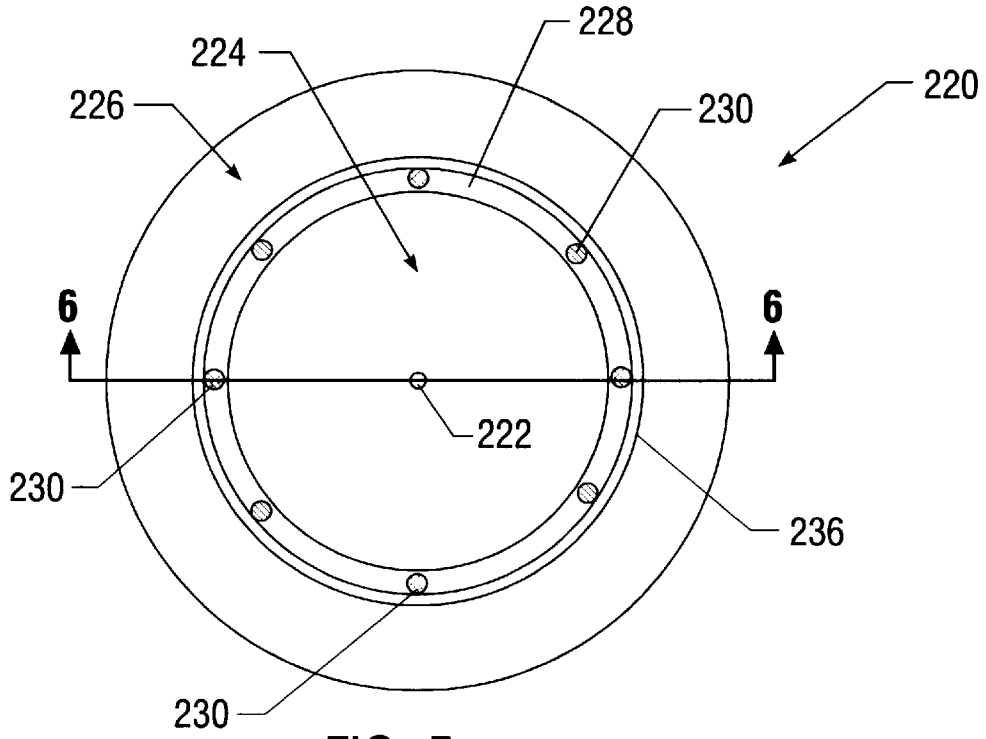
FIG. 5 is a plan view of a further polish platen constructed in accordance with the principles of the present invention.
Figure 6:
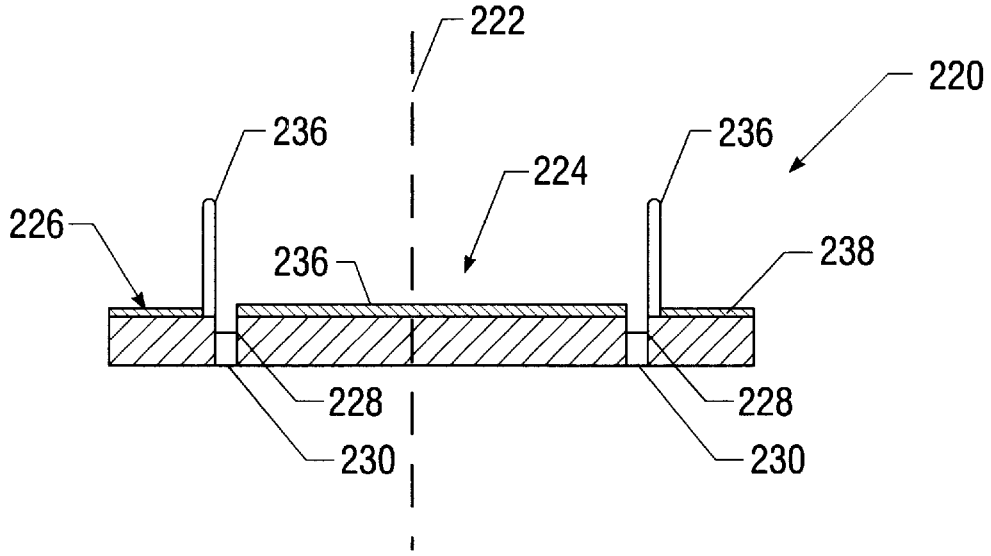
FIG. 6 is a cross-sectional view taken along section line 6—6 of FIG. 5.

FIGS. 5 and 6 illustrate another alternative polish platen 220 constructed in accordance with the principles of the present invention. Similar to the previous embodiments, the polish platen 220 is rotatable about a central axis 222 and includes separate inner and outer zones 224, 226. The zones 224, 226 are separated by an annular channel 228 which is in fluid communication with a plurality of drainage passageways 230 for discharging fluid that accumulates in the annular channel 228. The first and second zones 224, 226 are aligned at substantially the same elevation and have polishing surfaces aligned substantially within a single plane. An annular baffle 236 extends around the perimeter of the annular channel 228 and functions to help prevent polishing fluid such as slurry or rinse fluid from moving from the inner zone 224 to the outer zone 226. The polish platen 220 also includes an inner polish pad 236 mounted at the inner zone 224 and an outer polish pad 238 mounted at the outer zone 226. As previously described with respect to the other embodiments, the inner and outer polish pads 236, 238 may have similar or different mechanical polish properties/characteristics.

Figure 7:
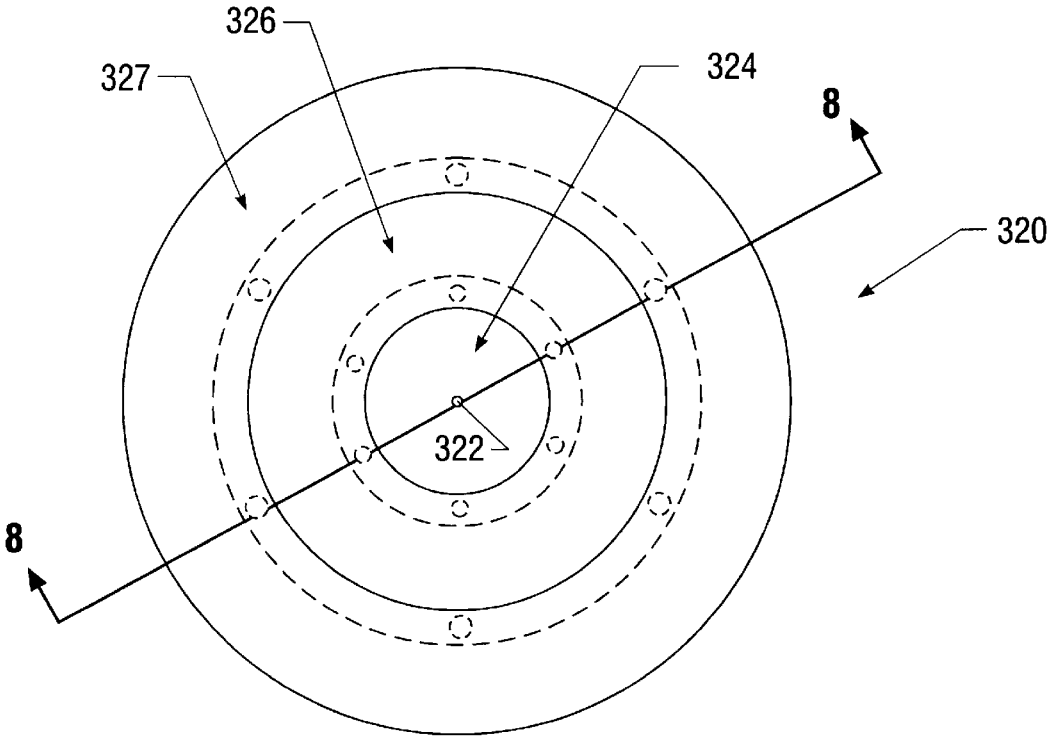
FIG. 7 is a plan view of still another polish platen constructed in accordance with the principles of the present invention.
Figure 8:
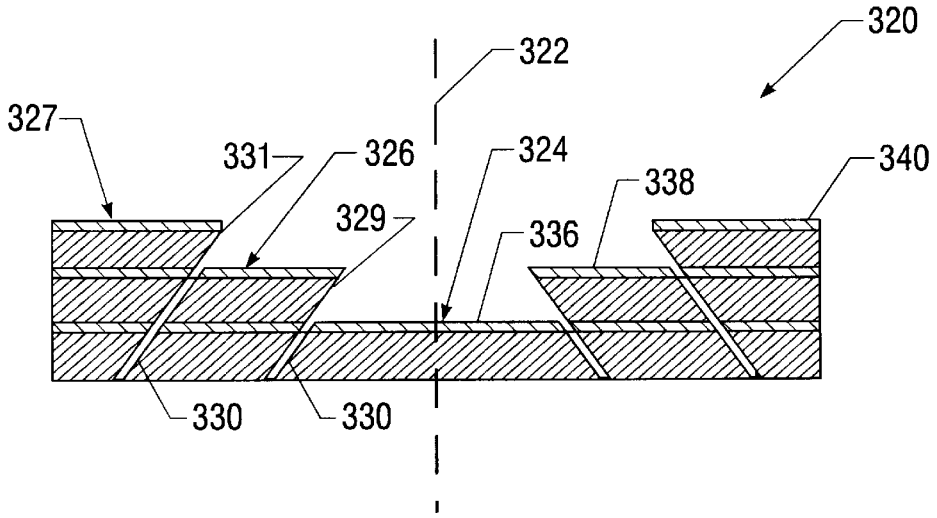
FIG. 8 is a cross-sectional view taken along section line 8—8 of FIG. 7.

FIGS. 7 and 8 illustrate another polish platen 320 constructed in accordance with the principles of the present invention. The polish platen 320 is rotatable about a central axis 322 and has a stepped configuration which divides the platen 320 into a first zone 324, a second zone 236, and a third zone 327.

The first zone 324 is recessed with respect to the second zone 326 and has a generally circular polishing surface. The first and second zones 324, 326 are separated by a first annular wall 329 that surrounds the first zone 324 and is aligned at an oblique angle with respect to the polishing surface of the first zone 324. The first radial wall 329 is oriented such that the first zone 324 undercuts the second zone 326 to maximize the working surface area of the polish platen 320.

The second zone 326 of the polish platen 320 is recessed with respect to the third zone 327 of the polish platen 320. The second zone 324 is separated from the third zone 327 by a second annular wall 331 that undercuts the third zone 327 to maximize the surface area of the polish platen 320. As shown in FIG. 8, the second annular wall 331 forms an oblique angle with respect to the polishing surface of the second zone 326. The elevation differences provided by the first and second annular walls 329, 331 are preferably sufficiently large to prevent fluid transfer between the zones 324, 326, 327.

Referring back to FIG. 8, the first, second and third polish pads 336, 338, 340 are respectively positioned at the first, second and third zones 324, 326, 327. Additionally, the polish platen 320 defines a plurality of discharge passageways 330 arranged and configured for discharging fluid that is applied to the first and second zones 324, 326. Specifically, the drainage passageways 330 have entrance ports located at the radially outermost portions of the first and second zones 324, 326 and extend through the platen 320 in a downward and radially outward direction.

Figure 9:
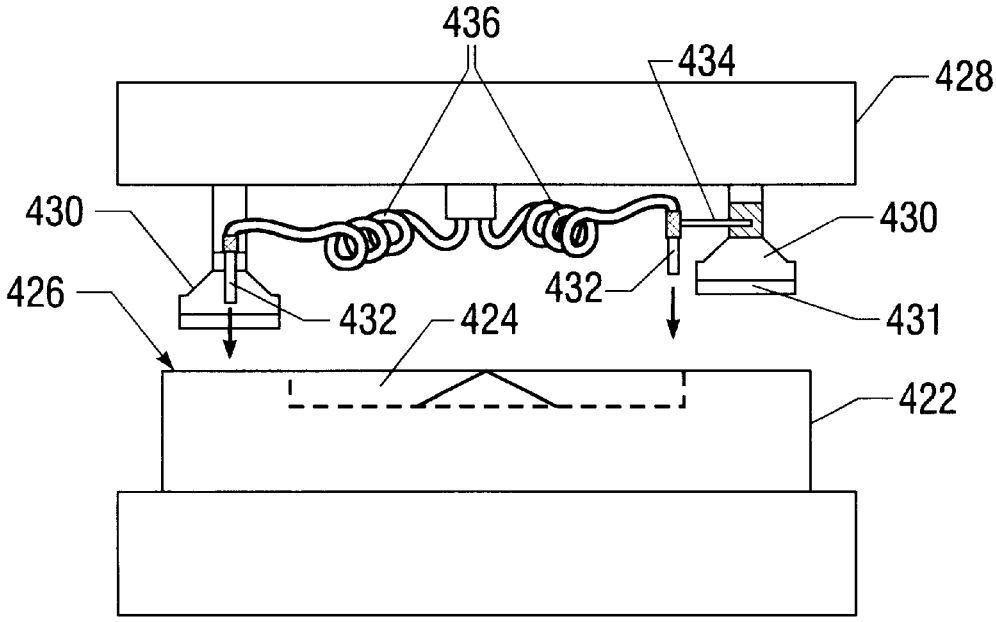
FIG. 9 illustrates an exemplary chemical mechanical polishing system constructed in accordance with the principles of the present invention.
Figure 10:
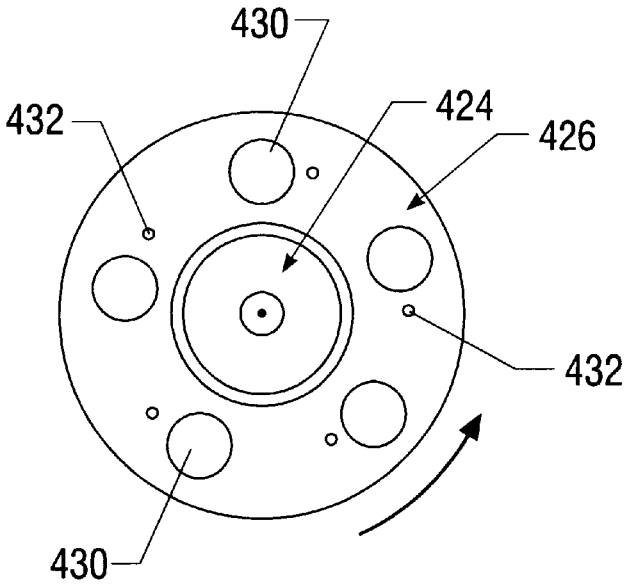
FIG. 10 is a schematic plan view of the system of FIG. 9.

FIGS. 9 and 10 illustrate a chemical mechanical polishing system 420 constructed in accordance with the principles of the present invention. This system 420 includes a rotatable platen 422 divided into a first zone 424 and a separate second zone 426. A carrier multi-head 428 is positioned above the platen 422. The multi-head 428 includes a plurality of rotatable carrier heads 430. Wafers 431 can be secured to the carrier heads 430 by known techniques such as vacuum pressure. The carrier heads 430 are radially movable with respect to the platen 422 such that the carrier heads 430 can be positioned above either the first zone 424 or the second zone 426.

Slurries, rinses, or other fluids/chemicals used in the chemical mechanical polishing process are supplied to the platen 422 by nozzles 432 secured to the carrier heads 430. The nozzles are secured to the carrier heads 430 by brackets 434 adapted for allowing the nozzles 432 to be pivoted 360° about the carrier heads 430. Fluid is provided to the nozzles 432 by flexible tubing 436. The flexible tubing 436 is in fluid communication with known sources of polishing fluid typically used in the chemical mechanical polishing field. Exemplary fluids include slurries having abrasives such as ultra-high purity silica or alumina dispersed in alkaline or acidic solutions, pad conditioners, ammonia, detergents, surfactants, and washing fluids such as deionized water. Those skilled in the art will appreciate that the fluid flow through the flexible tubing 436 can be controlled by known valve configurations.

In one exemplary use, wafers are first mounted on the carrier heads 430 and the carrier heads 430 are moved above the second zone 426. Next, the plate 422 is rotated and first slurry from the nozzles 432 is distributed to the second zone 426 such that a polish pad associated with the second zone 426 becomes saturated with slurry. Once the pad is completely saturated, the carrier heads 430 are rotated and moved downward such that the wafers are pressed against the polish pad of the second zone. As the wafers are pressed against the polish pad of the second zone 426, the wafers are both mechanically and chemically polished.

After the polish process has been completed at the second zone 426, the carrier heads 430 are lifted above the platen 422 and moved radially inward to positions above the first zone 424. A second slurry is then distributed from the nozzles 432 to a pad associated with the first zone 424. As the second slurry is provided to the first zone 424, the platen 422 is rotated, causing the second slurry to be evenly distributed over the pad associated with the first zone 424. The carrier heads 430 then rotate the wafers and press the rotating wafers against the pad of the first zone 424 such that the wafers are subjected to a second independent polishing process. An elevation difference between the first and second zones 424, 426 prevents the second slurry from moving from the first zone 424 to the second zone 426.

It will be appreciated that the pad associated with the first zone 424 can have different polishing characteristics than the pad associated with the second zone 426. For example, the pad associated with the first zone 424 can comprise a buffing pad having soft polishing characteristics suitable for secondary polishing of wafers. In contrast, the polishing pad associated with the second zone 426 can be a primary polishing pad having hard polishing characteristics suitable for primary polishing of a wafer. Similarly, the first and second slurries can have different polish characteristics. For example, the first slurry can comprise a primary polishing slurry while the second slurry can comprise a secondary polishing slurry. The nozzles 432 can also provide other fluids used in chemical mechanical polishing such as washing or rinsing fluids.

Figure 11:
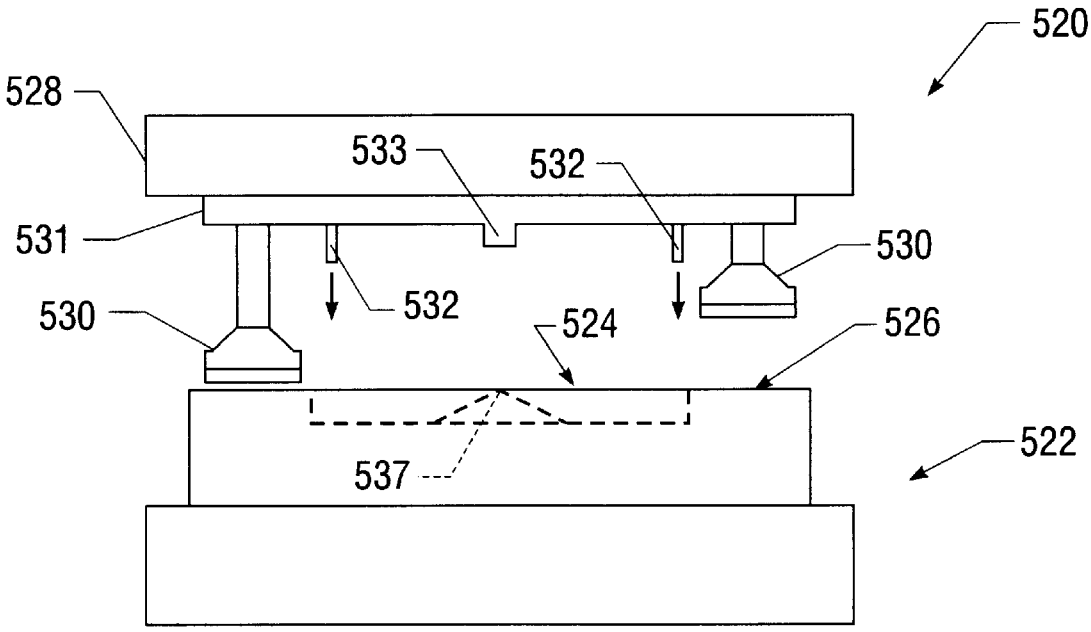
FIG. 11 is another exemplary chemical mechanical polishing system constructed in accordance with the principles of the present invention.
Figure 12:
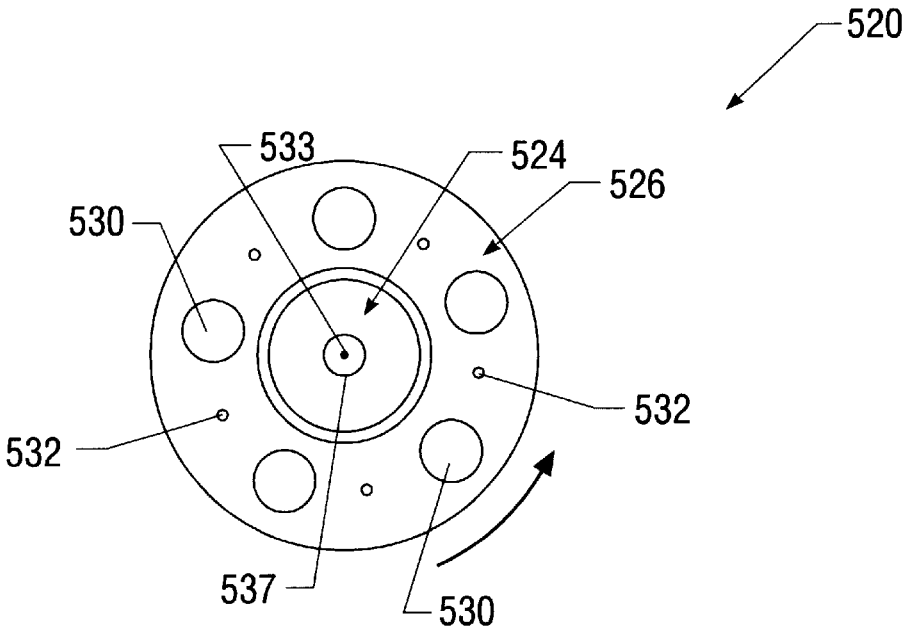
FIG. 12 is a schematic plan view of the system of FIG. 11.

FIGS. 11 and 12 show another chemical mechanical polishing system 520 constructed in accordance with the principles of the present invention. The system 520 includes a rotatable platen 522 divided into a first zone 524 and a second zone 526. A carrier multi-head 528 is positioned above the platen 522. The multi-head 528 includes a plurality of rotatable carrier heads 530 suitable for carrying wafers. A nozzle bar 531 is secured to a fixture adjacent to the platen 522 such as the bottom of the multi-head 528. The nozzle bar 531 includes a central nozzle 533 arranged for distributing fluids such as slurry or wash fluid to a distribution cone 537 located on the first zone 524. The nozzle bar 531 also includes a plurality of outer nozzles 532 positioned at fixed locations above the second zone 526 for distributing fluid to the second zone 526. By controlling fluid flow to the central nozzle 533 and the outer nozzles 532, fluids such as slurries or rinses can selectively be provided independently to the first zone 524 and the second zone 526 during independent polishing steps.

Figure 13:
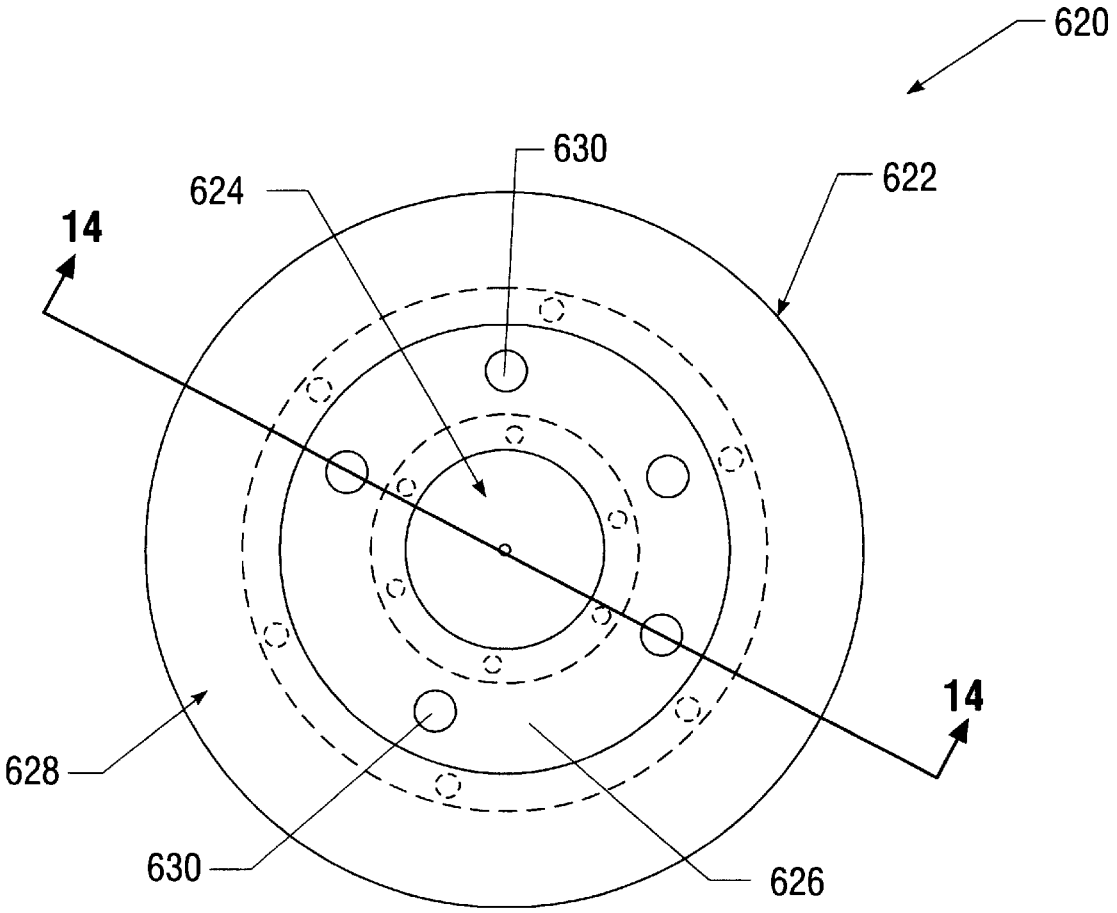
FIG. 13 is a further exemplary chemical mechanical polishing system constructed in accordance with the principles of the present invention.
Figure 14:
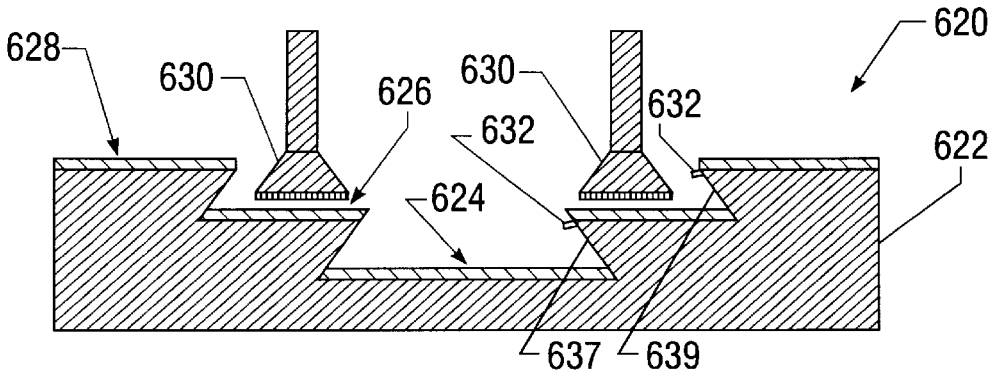
FIG. 14 is a cross-sectional view of the polishing system of FIG. 13 taken along section line 14—14.

FIGS. 13 and 14 illustrate another chemical mechanical polishing system 620 constructed in accordance with the principles of the present invention. The system 620 includes a platen 622 having a stepped configuration that divides the platen 622 into a first zone 624, a second zone 626, and a third zone 627. Radially and vertically moveable carrier heads 630 are used to move wafers between the first, second and third zones 624, 626, 627 during independent polishing procedures associated with each zones. Slurries or other known chemical mechanical polishing fluids are provided to the first and second zones 624, 626 by nozzles 632 connected to the platen 622. Specifically, the nozzles 632 are connected to inclined radial walls 637, 639 of the platen 622 and function to evenly distribute fluid over the first and second zones 624, 626.

With regard to the foregoing description, it is to be understood that changes may be made in detail, especially in matters of the construction materials employed and the size, shape and arrangement of the parts without the departing from the scope of the present invention. For example, a given platen can be divided into an infinite number of zones without departing from the scope of the present invention. Additionally, although the platens illustrated in the present application relate to rotatable platens, it will be appreciated that the principles of the present invention also apply other platen designs such as linear oscillating platens. Furthermore, any of the separating structures disclosed herein such as height differences, baffles, channels, or other separating techniques, can be used alone or in a variety of combinations to divide a platen into multiple zones. Moreover, platens in accordance with the principles of the present invention can be used with single-head or multi-head polishing devices. It is intended that the specification and depicted aspects of the invention be considered exemplary only with a true scope and spirit of the invention being indicated by the broadening of the following claims.

What is claimed:

1. A chemical mechanical polishing apparatus used for polishing wafers comprising:

a platen; and a baffle for separating the platen into at least first and second zones, there being a height difference between said first and second zones, such that polishing fluid used in the first zone is prevented from entering the second zone, the baffle being aligned at an oblique angle with respect to a top surface of the platen.

2. A chemical mechanical polishing apparatus used for polishing wafers comprising:

a platen;

a fluid divider for dividing the platen into at least two separate zones, wherein the fluid divider is a height difference between the two separate zones;

a carrier having a rotatable head for mounting a wafer, the carrier being radially moveable relative to the platen; and a fluid dispenser secured to the carrier such that the fluid dispenser is radially moved relative to the platen by the carrier.

3. The apparatus of claim 1, wherein the first zone is positioned lower than the second zone, and wherein the baffle extends at least partially over the first zone and has a base end positioned below the second zone.

4. The apparatus of claim 2, wherein the platen is rotatable about a central axis of rotation.

5. The apparatus of claim 1, wherein the first zone is inside the second zone.

6. The apparatus of claim 5, wherein the first zone is circular and the second zone is annular.

7. The apparatus of claim 1, wherein the second zone is arranged and configured to overhang the first zone.

8. The apparatus of claim 1, further comprising drains for draining polishing fluid from the first zone.

9. The apparatus of claim 1, further comprising first and second polish pads mounted respectively on the first and second zones, the first and second polish pads having different polishing characteristics.

10. The apparatus of claim 9, where the first pad is a primary polish pad, and the second pad is a secondary polish pad.

11. The apparatus of claim 9, wherein the first pad is softer than the second pad.

12. The apparatus of claim 1, further comprising means for selectively providing polishing fluid to the first and second zones.

13. The apparatus of claim 12, wherein the means for providing polishing fluid comprises a plurality of nozzles positioned above the platen.

14. The apparatus of claim 13, wherein the nozzles are mounted at fixed radial positions relative to the platen.

15. The apparatus of claim 13, wherein the nozzles are radially adjustable.

16. The apparatus of claim 12, further comprising a carrier having a rotatable head for mounting the wafer.

17. The apparatus of claim 16, wherein the means for providing polishing fluid comprises a nozzle secured to the carrier.

18. The apparatus of claim 12, wherein the means for providing polishing fluid comprises a nozzle secured to the platen.

19. The apparatus of claim 1, wherein the polish platen is rotatable about a central axis of rotation.

20. A chemical mechanical polish method for polishing a wafer comprising:

providing a polish platen including first and second zones positioned at different heights, the first zone having a first polish pad and the second zone having a second polish pad;

applying a first polishing fluid to the first pad and polishing the wafer at the first pad;

using the difference in heights between the first and second zones to prevent the first polishing fluid from contacting the second pad; and applying a second polishing fluid to the second pad and polishing the wafer at the second pad.

21. The method of claim 20, wherein the first polishing pad comprises a primary polish pad, and the second polishing pad comprises a secondary polish pad.

22. The method of claim 20, wherein the first and second pads have different polish characteristics.

23. The method of claim 20, wherein the first and second polishing fluids have different polish characteristics.

24. The method of claim 23, wherein the first and second polishing fluids are incompatible.

25. A chemical mechanical polishing apparatus used for polishing wafers comprising:

a platen including first and second polishing zones having different heights such that polishing fluid used in the first zone is prevented from entering the second zone, the second zone being arranged and configured to overhang the first zone.

* * * * *